United States Patent [19]

Munier et al.

[11] Patent Number: 4,749,903

[45] Date of Patent: Jun. 7, 1988

[54] HIGH-PERFORMANCE PHOTOCATHODE

[75] Inventors: Bernard Munier, Seyssinet Pariset; Paul de Groot, Grenoble; Claude Weibuch, Paris; Yves Henry, Eybens, all of France

[73] Assignee: Thomson CSF, Paris, France

[21] Appl. No.: 934,481

[22] Filed: Nov. 24, 1986

[30] Foreign Application Priority Data

Nov. 29, 1985 [FR] France ..... 85 17719

[51] Int. Cl.[4] ..... H01J 31/10; H01J 31/26

[52] U.S. Cl. ..... 313/366; 313/386; 357/30

[58] Field of Search ..... 313/366, 368, 542, 499, 313/501; 357/17, 30, 31

[56] References Cited

U.S. PATENT DOCUMENTS

| | | | |
|---|---|---|---|
| 3,743,899 | 7/1973 | Anthony et al. | 313/366 |
| 3,958,143 | 5/1976 | Bell | 313/542 |
| 4,587,456 | 5/1986 | Inoue et al. | 313/366 |

*Primary Examiner*—David K. Moore
*Assistant Examiner*—K. Wieder
*Attorney, Agent, or Firm*—Cushman, Darby & Cushman

[57] ABSTRACT

In one example of construction, a high-performance photocathode has the following structure:

- a transparent layer formed of P+ type semiconductor material having a forbidden band of sufficient width to ensure that this layer is transparent to the photons of the light to be detected;
- an absorption layer constituted by ten first sublayers formed of P+ type semiconductor material with a forbidden band of sufficiently small width to have two-dimensional electronic properties in order to achieve efficient conversion of the photons into electron-hole pairs and by ten second sublayers interposed between the first and formed of the same material as the transparent layer, the second sublayers being sufficiently thin to permit passage of electrons by tunnel effect and the thickness of the first sublayers being sufficient to permit absorption of the photons of all wavelengths of the light to be detected;
- a transport layer formed of the same material as the first sublayers;
- a layer of Cs+O for reducing the energy-gap potential so as to permit emission of electrons into vacuum.

2 Claims, 1 Drawing Sheet

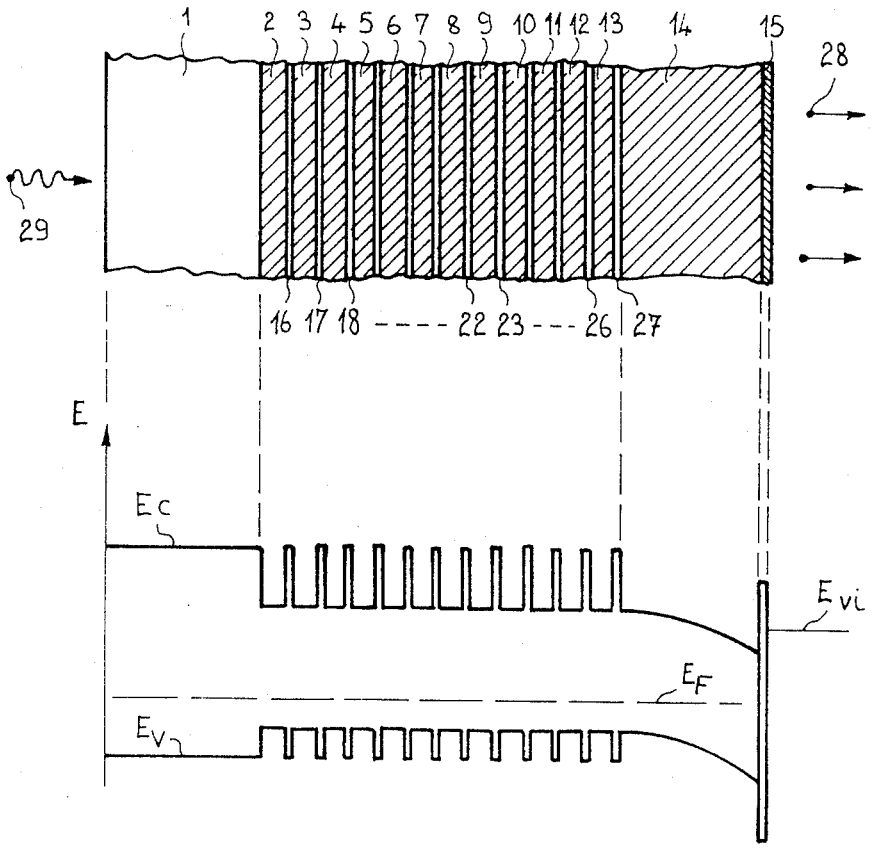
1
2
3
4
5
6
7
8
9
10
11
12
13
14
15
28
29
16
17
18
22
23
26
27
E
Ec
Evi
EF
Ev

HIGH-PERFORMANCE PHOTOCATHODE

BACKGROUND OF THE INVENTION

This invention relates to a high-performance photocathode for use in pickup tubes such as television camera tubes and image intensifier tubes.

It is known to construct a photocathode having the following main components:

- a so-called window layer consisting of P+ type semiconductor material in which the forbidden band is of sufficient width to ensure that said layer is transparent to the wavelengths of the light to be detected and which is bonded to a glass wall for receiving the light to be detected;
- a so-called absorption layer consisting of P+ type semiconductor material in which the forbidden band is of sufficiently small width to convert the light photons to be detected into electron-hole pairs;
- a so-called emission layer consisting of material which produces negative electron affinity at the end of the absorption layer in order to emit into vacuum the electrons which are released within the absorption layer.

The maximum detectable wavelength is limited by the width of the forbidden band of the material which constitutes the absorption layer. By applying a positive bias to said layer at the end opposite to the window layer, it is possible to employ materials which have a small forbidden bandwidth while maintaining good emission efficiency and it is therefore possible to detect light having longer wavelengths. A bias can be applied to the absorption layer by means of a connection with said layer or by a very thin metallic electrode interposed between said layer and the emission layer. A photocathode of this type is described in the article by J. J. Escher et al., IEEE-EDL2, 123–125 (1981).

The performance of a photocathode of this type is limited in particular by the characteristics of the absorption layer. The thickness of this layer is in fact determined by making a compromise between on the one hand high absorption of photons of the light to be detected, which requires a thickness as great as possible, and on the other hand high efficiency of transmission of electrons as well as a low dark current, which calls for minimum thickness of the absorption layer, also in order to obtain two-dimensional quantization of energy levels of electrons and holes in the plane of the sublayers.

As a general rule, the thickness of this layer is of the order of 1 micron. This permits good efficiency of transmission of electrons but is not sufficient to absorb all the photons of the light to be detected, especially the photons corresponding to the longest wavelengths. The object of the invention is to provide a photocathode which offers higher efficiency than photocathodes of known types. The invention is accordingly directed to a photocathode having an absorption layer constituted by a plurality of individual sublayers so as to achieve at the same time very good absorption of photons, high efficiency of transmission of electrons released by the photons and a low dark current.

SUMMARY OF THE INVENTION

In accordance with the invention, a high-performance photocathode essentially comprises a so-called absorption layer constituted by a plurality of first sublayers formed of semiconductor material having a sufficiently narrow forbidden bandwidth and having a sufficient thickness to convert the photons of light to be detected into electron-hole pairs. Said first sublayers are arranged in alternate sequence with a plurality of second sublayers formed of semiconductor material having a forbidden bandwidth of higher value than that of the first sublayers, the thickness of said second sublayers being sufficiently small to ensure that the electrons are capable of passing through them by tunnel effect. Doping of the first and second sublayers makes it possible to obtain two-dimensional quantization of the energy levels of electrons and holes in the plane of the first sublayers and to adjust the Fermi level so as to be close to the level of valence of the first sublayers.

BRIEF DESCRIPTION OF THE DRAWING

The upper portion of the single FIGURE is a fragmentary sectional view of one example of construction of the photocathode in accordance with the invention.

The lower portion of the same figure is a diagram of energy levels E of the carriers in this example of construction.

DESCRIPTION OF A PREFERRED EMBODIMENT

The embodiment considered by way of example comprises:

- a first layer 1 bonded to a glass wall (not shown) through which said layer receives photons 29, said layer 1 being transparent to all wavelengths of light to be detected and the function of said first layer being to permit bonding of the cathode to the glass wall;
- an absorption layer consisting of twelve first sublayers 2 to 13 and twelve second sublayers 16 to 27 arranged alternately with the first;
- a so-called transport layer 14 which has the function of transmitting to vacuum electrons which are released within the absorption layer;
- a last layer 15 consisting of material which reduces the electron affinity of the surface of the layer 14 in order to enable it to emit electrons 28 into vacuum.

The lower portion of the FIGURE represents the curves Ec and Ev of energy levels of the conduction band and of the valence band within the semiconductor layers, the Fermi level $E_F$ of these layers and the energy gap potential $E_{vi}$.

The layer 1 is formed of P+ type semiconductor material consisting of $Ga_{0.6}Al_{0.4}As$ doped with $5\times10^{17}$ atoms of zinc per $cm^3$, which has a forbidden bandwidth equal to 2 eV and which is therefore transparent to all wavelengths of light to be detected. The first sublayers 2 to 13 and the layer 14 are formed of P+ type semiconductor material having a smaller forbidden bandwidth than that of the material of the layer 1 (1.4 eV, for example) in order to absorb all the photons to be converted into electron-hole pairs. In this example, the sublayers 2 to 13 are formed of GaAs doped with $10^{19}$ atoms of zinc per $cm^3$ and each have a thickness of 0.025 micron. The layer 14 is formed of GaAs doped with $10^{19}$ atoms of zinc per $cm^3$ and has a thickness of 0.1 micron. Its thickness must be greater than that of the space charge zone owing to the presence of the semiconductor surface, the width of this zone being smaller than 0.05 micron.

The second sublayers 16 to 27 are formed of the same material as the layer 1 in this example of construction and therefore have the same forbidden bandwidth. Said second sublayers are either lightly doped or undoped so as to ensure that the energy level curves make it possible to obtain in the sublayers 2 to 13 two-dimensional quantization of the energy levels of the electrons and of the holes. This two-dimensional quantization produces an increase in the photon absorption coefficient. The sublayers 16 to 27 each have a thickness of 0.003 micron which enables the electrons to pass through said sublayers by tunnel effect and achieves good efficiency of transmission of the electrons released by the photons within the sublayers 2 to 13. The thickness of the sublayers 16 to 27 must be smaller than 0.0045 micron in order to ensure good electron transmission efficiency. The thickness of the sublayers 2 to 13 must be smaller than 0.03 micron in order to obtain the increase in absorption coefficient which is due to two-dimensional quantization of the energy levels of electrons and holes in the plane of the sublayers 2 to 13. The thickness of said sublayers must nevertheless be sufficiently great to avoid unduly raising the threshold of absorption of photons by quantum confinement effect in order to permit absorption of longwavelength photons.

The energy level $E_c$ of the conduction band and the energy level Ev of the valence band have potential steps corresponding to the sublayers 16 to 27. It is possible to demonstrate by calculation that this alternate arrangement of sublayers produces a higher photon absorption coefficient than an absorption layer consisting of homogeneous semiconductor material. In this example of construction, the absorption coefficient is multiplied by a factor of 3 with respect to a photocathode of known type.

The layer 15 is formed of a very thin layer of Cs+O which has the effect of reducing the energy-gap potential $E_{vi}$ to a value below the level of the conduction band of the sublayers 2 to 13 in order to facilitate emission of the electrons 28 into the energy gap. Since the layer 15 is extremely thin, the electrons pass through said layer by tunnel effect.

The scope of the invention is not limited to the embodiment described by way of example in the foregoing. Many alternative forms of construction are within the capacity of those versed in the art, especially in regard to the number of sublayers and constituent materials. The material which forms the sublayers 16 to 27 can be different from the material of the window 1 with light P-type or N-type doping or without doping. A choice must be made accordingly in regard to the type of doping adopted for the sublayers 2 to 13 in order to ensure that the Fermi level $E_F$ of all the sublayers 2 to 13 and 16 to 27 are close to the level of the valence band of the sublayers 2 to 13 and that there takes place a two-dimensional quantization of energy levels of the carriers in the plane of the sublayers 2 to 13. It is within the capacity of any one versed in the art to choose materials which satisfy these two conditions. For example, the sublayers 2 to 13 can consist of $Ga_yAs_{1-x}In_xP_{1-y}$ and the sublayers 16 to 27 can accordingly consist of InP. In another variant, the sublayers 2 to 13 can consist of GaSb and the sublayers 16 to 27 consist in that case of GaAlAsSb. However, it may prove desirable to ensure that the semiconductor material employed for forming the sublayers 16 to 27 has a crystal lattice parameter which is close to that of the material of the sublayers 2 to 13 in order to avoid any increase in the dark current of the photocathode.

In the example of construction described in the foregoing, the Fermi level $E_F$ of the different semiconductor layers is identical and biasing is not provided. In order to permit detection of photons of higher wavelengths, biasing may be carried out in the same manner as in the prior art, namely by means of a thin metallic electrode located between the layer 14 and the layer 15 or by means of a lead for connecting the layer 14 to the positive terminal of a generator, the negative terminal of which is connected to the layer 1.

The invention can be applied to pickup tubes for television camera and to image intensifier tubes.

What is claimed is:

1. A high-performance photocathode, wherein a absorption layer constituted by a plurality of first sublayers formed of semiconductor material having a sufficiently narrow forbidden bandwidth and having a sufficient thickness to convert the photons of light to be detected into electron-hole pairs, said first sublayers being arranged in alternate sequence with a plurality of second sublayers formed of semiductor material having a forbidden bandwidth of higher value than that of the first sublayers, the thickness of said second sublayers being sufficiently small to ensure that the electrons are capable of passing through them by tunnel effect, doping of the first and second sublayers being such as to permit two-dimensional quantization of the energy levels of electrons and holes in the plane of the first sublayers and to adjust the Fermi level so as to be close to the level of valence of the first sublayers.

2. A photocathode according to claim 1, wherein the first sublayers forming the absorption layer consist of GaAs and each have a thickness smaller than 0.03 micron, and wherein the second sublayers consist of $Ga_{0.6}Al_{0.4}As$ and have a thickness smaller than 0.0045 micron.

* * * * *